US012668939B2

(12) United States Patent
Dombrock et al.

(10) Patent No.: US 12,668,939 B2
(45) Date of Patent: Jun. 30, 2026

(54) LIQUID CIRCULATOR

(71) Applicant: Kasco Marine, Inc., Prescott, WI (US)

(72) Inventors: Todd Dombrock, Prescott, WI (US); Nick Frazer, Prescott, WI (US)

(73) Assignee: Kasco Marine, Inc., Prescott, WI (US)

( * ) Notice: Subject to any disclaimer, the term of this patent is extended or adjusted under 35 U.S.C. 154(b) by 165 days.

(21) Appl. No.: 18/361,065

(22) Filed: Jul. 28, 2023

(65) Prior Publication Data

US 2023/0366163 A1 Nov. 16, 2023

Related U.S. Application Data

(63) Continuation-in-part of application No. 17/664,735, filed on May 24, 2022, now abandoned.

(60) Provisional application No. 63/192,743, filed on May 25, 2021.

(51) Int. Cl.
*E02B 1/00* (2006.01)
*F04D 13/08* (2006.01)
*F04D 29/54* (2006.01)

(52) U.S. Cl.
CPC ..... *E02B 1/003* (2013.01); *F04D 13/086* (2013.01); *F04D 29/548* (2013.01)

(58) Field of Classification Search
CPC ..... E02B 1/003; F04D 33/00; F04D 13/021; F04D 13/028; F04D 13/08; F04D 13/086; F04D 15/00; F04D 29/005; F04D 29/605; F04D 2260/40311; F04D 2260/4021; B01F 27/25; B01F 25/54
See application file for complete search history.

(56) References Cited

U.S. PATENT DOCUMENTS

| | | | | |
|---|---|---|---|---|
| 2,091,247 | A * | 8/1937 | Williams, Jr. | B63H 20/22 440/89 C |
| 10,392,763 | B2 | 8/2019 | Stone | |
| 12,083,488 | B2 | 9/2024 | Johnson et al. | |
| 2009/0256269 | A1 | 10/2009 | Sun et al. | |
| 2014/0061957 | A1* | 3/2014 | Geremia | B01F 23/23 261/24 |

(Continued)

OTHER PUBLICATIONS

"Aquasweep—Maintain a Healthy Aquatic Environment", Scott Aerator, 2021, 8 pages, available at https://www.manualslib.com/manual/1949778/Scott-Aerator-Aquasweep.html?page=2#manual.

*Primary Examiner* — Amber R Anderson
*Assistant Examiner* — Stacy N Lawson
(74) *Attorney, Agent, or Firm* — Merchant & Gould P.C.

(57) ABSTRACT

A liquid circulator is described that is configured to circulate liquids such as water, chemical mixtures, suspensions and the like. The liquid circulator includes an oscillation shaft, a circulation assembly mounted to the oscillation shaft, and a head unit located above the circulation assembly with a motor having an output shaft in driving engagement with the oscillation shaft. The liquid circulator may be devoid of a processor controlling operation of the liquid circulator. The circulator can also include a rotary to oscillation drive mechanism between the output shaft and the oscillation shaft that is configured to convert rotation of the output shaft into clockwise and counterclockwise oscillation of the oscillation shaft. In another example, an automatic clutch mechanism can be provided between the output shaft and the oscillation shaft.

7 Claims, 12 Drawing Sheets

(56) References Cited

U.S. PATENT DOCUMENTS

2017/0335531 A1 11/2017 Smothers et al.
2018/0251947 A1* 9/2018 Stone ..... B01F 35/221

* cited by examiner

LIQUID CIRCULATOR

FIELD

This technical disclosure relates to a device for circulating liquids such as water, chemical mixtures, or suspensions.

BACKGROUND

It is known to use a water circulator to create water circulation in a body of water to improve water quality and remove debris and sediment buildup. The water circulator may be fixed in position or it may oscillate to expand the area impacted by the circulating water.

SUMMARY

A circulator is described that is configured to circulate liquids such as water, chemical mixtures, suspensions and the like. In one embodiment, the circulator can be used to create a continuous flow of water in a body of water including around marinas, areas around docks, and waterfronts. In this embodiment, the continuous water circulation created by the circulator helps to eliminate stagnant areas, remove weeds and debris and increase oxygen transfer, as well as prevent freezing of the water within the vicinity of the circulator. In another embodiment, the circulator described herein can be used to create circulation in other bodies of liquid including, but not limited to, treatment tanks for water and/or chemicals for mixing the contents to keep solids and chemicals in suspension and evenly distributed. The circulator described herein may also be referred to as a water circulator or as a liquid circulator.

The liquid circulator includes an oscillation shaft that is rotatable in clockwise and counterclockwise directions. A circulation assembly is mounted to the oscillation shaft at a lower end thereof. The circulation assembly includes a rotatable propeller that circulates a liquid, and a drive motor connected to the rotatable propeller to rotate the rotatable propeller. A head unit is located above the circulation assembly and includes a motor with a rotary output shaft in driving engagement with the oscillation shaft.

The liquid circulator includes a number of unique features that can be used individually or in any combination thereof. For example, the liquid circulator is devoid of a processor, microprocessor, microcontroller, etc. controlling operation of the liquid circulator. In another example, a rotary to oscillation drive mechanism between the rotary output shaft and the oscillation shaft that is configured to convert rotation of the rotary output shaft into clockwise and counterclockwise oscillation of the oscillation shaft. In another example, an automatic clutch mechanism can be provided between the rotary output shaft and the oscillation shaft. The motor in the head unit can be an alternating current motor or a direct current motor. Also, in an embodiment, a mount bracket can be attached to the head unit where the mount bracket is configured to mount the liquid circulator to a support structure such as a dock.

In an embodiment, a liquid circulator can include an oscillation shaft that is rotatable in clockwise and counterclockwise directions. A circulation assembly is mounted to the oscillation shaft at a lower end thereof, and the circulation assembly includes a rotatable propeller that circulates a liquid, and a drive motor connected to the rotatable propeller to rotate the rotatable propeller. A head unit is located above the circulation assembly, with the head unit including a motor with an output shaft in driving engagement with the oscillation shaft. In addition, the circulator is devoid of a processor controlling operation of the liquid circulator.

In another embodiment, a liquid circulator can include an oscillation shaft that is rotatable in clockwise and counterclockwise directions. A circulation assembly is mounted to the oscillation shaft at a lower end thereof, and the circulation assembly includes a rotatable propeller that circulates a liquid, and a drive motor connected to the rotatable propeller to rotate the rotatable propeller. A head unit is located above the circulation assembly and includes a motor with a rotary output shaft that rotates in a single direction. A rotary to oscillation drive mechanism is provided between the rotary output shaft and the oscillation shaft that is configured to convert rotation of the rotary output shaft into clockwise and counterclockwise oscillation of the oscillation shaft.

In another embodiment, a liquid circulator can include an oscillation shaft that is rotatable in clockwise and counterclockwise directions. A circulation assembly is mounted to the oscillation shaft at a lower end thereof, and the circulation assembly includes a rotatable propeller that circulates a liquid, and a drive motor connected to the rotatable propeller to rotate the rotatable propeller. A head unit is located above the circulation assembly and includes a motor with a rotary output shaft that rotates in a single direction. A rotary to oscillation drive mechanism is provided between the rotary output shaft and the oscillation shaft that is configured to convert rotation of the rotary output shaft into clockwise and counterclockwise oscillation of the oscillation shaft. In addition, the circulator is devoid of a processor controlling operation of the liquid circulator.

The circulator can include other unique features as well. The circulator has an oscillation shaft disposed within, for example concentrically disposed within, a support tube that is used to mount the circulator to a support structure such as a dock. Locating the oscillation shaft within the support tube makes the circulator more compact, achieves better alignment of the oscillation shaft and the support tube, and makes the circulator stronger compared to a circulator where the oscillation shaft is not disposed within a support tube.

In another embodiment, a circulator can include a support tube and an oscillation shaft disposed within the support tube, where the oscillation shaft is rotatable relative to the support tube in clockwise and counterclockwise directions. A head unit is mounted to the support tube and includes a housing, and an oscillation motor disposed in the housing and having an output drive shaft in driving engagement with the oscillation shaft to drive the oscillation shaft in clockwise and counterclockwise directions. In addition, a circulation assembly is mounted to the oscillation shaft at a lower end thereof, where the circulation assembly includes a rotatable propeller, and a drive motor connected to the rotatable propeller to rotate the rotatable propeller.

In another embodiment, the circulator can be used to create liquid circulation in a body of liquid, for example in treatment tanks for water and/or chemicals for mixing the contents to keep solids and chemicals in suspension and evenly distributed. In this example application, the circulator may be referred to as a liquid circulator.

DRAWINGS

DETAILED DESCRIPTION

Figure 1:
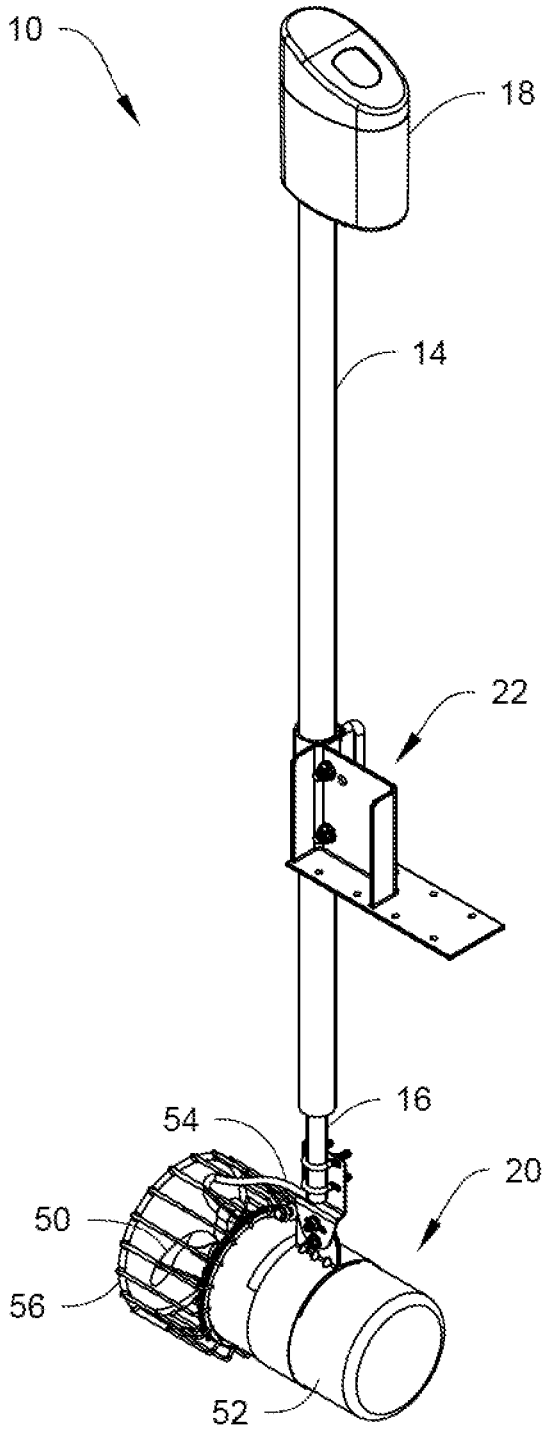
FIG. 1 is a perspective view of a circulator described herein.
Figure 2:
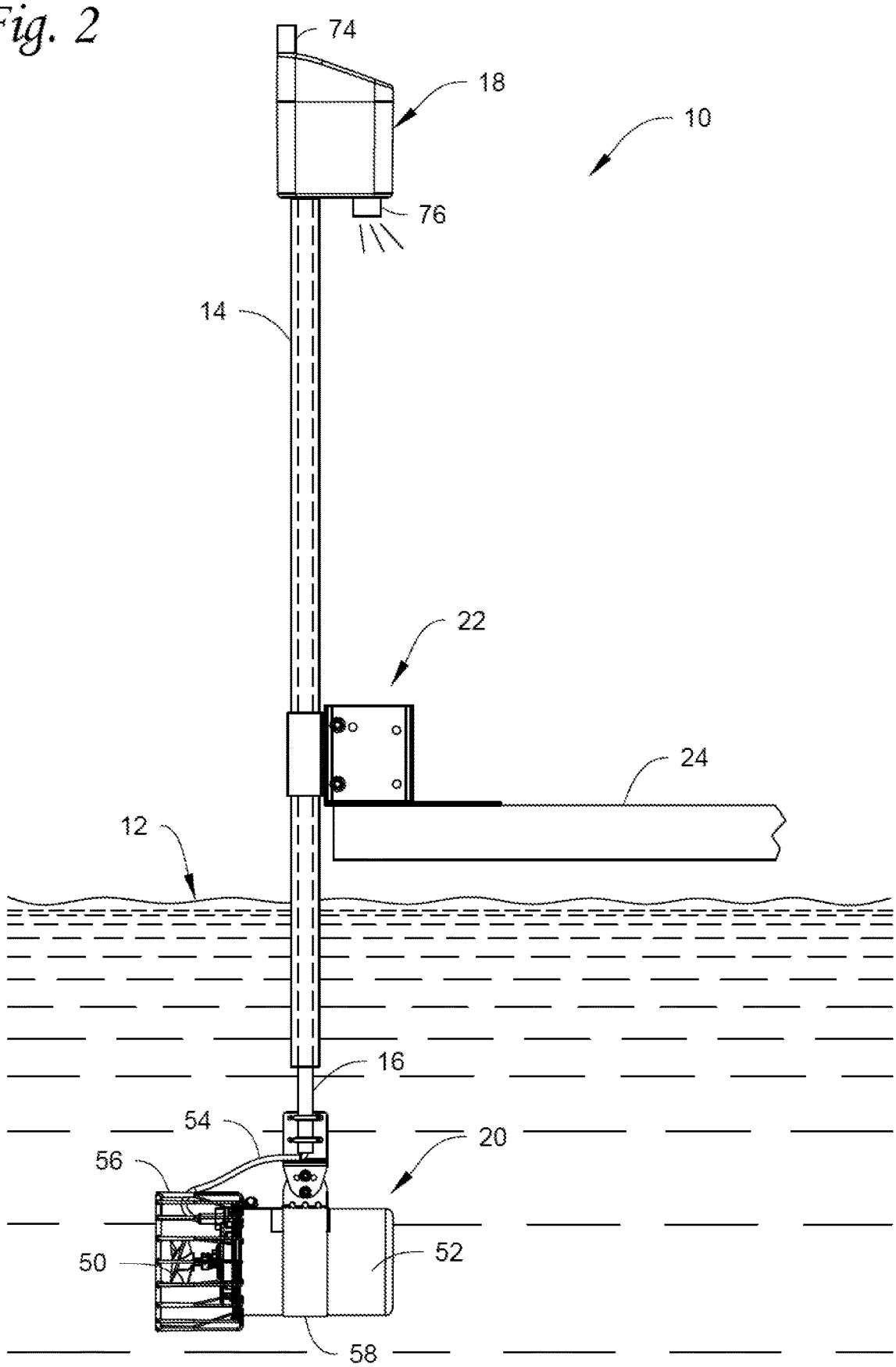
FIG. 2 is a side view of the circulator of FIG. 1.

Referring to FIGS. 1-2, a circulator 10 (also referred to as a water circulator or as a liquid circulator) is illustrated. The circulator 10 is configured to create a continuous circulation within a body of liquid 12 (shown in FIG. 2). For example, the body of liquid 12 can be a lake, pond, river, canal and the like, and the circulator 10 of FIGS. 1-2 can be used to circulate water in a localized area in the body of water. The localized area may be at or near a marina, around or adjacent to a dock, near a waterfront or other location, and other locations in a body of water. However, the circulator 10 can be used to create circulation in other bodies of liquid other than water or mixtures of water and other liquid(s) including, but not limited to, treatment tanks for water and/or chemicals for mixing the contents to keep solids and chemicals in suspension and evenly distributed.

With continued reference to FIGS. 1-2, the circulator 10 includes a support tube 14, an oscillation shaft 16, a head unit 18, and a circulation assembly 20. In operation of the circulator 10, the circulator 10 is mounted by the support tube 14 such that the head unit 18 is disposed above and out of the liquid and the circulation assembly 20 is disposed within the liquid for creating a circulation of the liquid.

The support tube 14 has a tubular configuration and has an upper end located out of the liquid and connected to the head unit 18 and can have a lower end disposed in the liquid. The support tube 14 is stationary or fixed, i.e. the support tube 14 does not rotate during use. The support tube 14 may be circular in cross-section or have another cross-sectional shape such as square, rectangular or triangular as long as the oscillation shaft 16 can extend through the support tube 14. The support tube 14 can be formed of material that is suitable for use in a liquid environment such as metal or plastic. A mount bracket 22 (or a dock mount when used as a water circulator in a body of water) is connected to the support tube 14 for mounting the support tube 14, and thus mounting the entire circulator 10, to a support structure 24 (visible in FIG. 2) such as a dock or pier when used as a water circulator. A suitable mount bracket that can be used is available from Kasco Marine of Prescott, Wisconsin.

The oscillation shaft 16 is disposed within and extends through the support tube 14. The oscillation shaft 16 is rotatable relative to the support tube 14 in clockwise and counterclockwise directions to cause oscillation of the circulation assembly 20 about the axis of the oscillation shaft 16 along a horizontal plane in clockwise and counterclockwise directions. The oscillation shaft 16 may be concentrically disposed within the support tube 14 so that the longitudinal axis of the oscillation shaft 16 matches the longitudinal axis of the support tube 14. The oscillation shaft 16 may be solid or tubular, and the oscillation shaft 16 may be circular in cross-section or have another cross-sectional shape such as square, rectangular or triangular as long as the oscillation shaft 16 can extend through the support tube 14 and rotate relative to the support tube 14. The oscillation shaft 16 can be formed of material that is suitable for use in a liquid environment such as metal or plastic. As described in more detail below, an upper end of the oscillation shaft 16 extends into the head unit 18 and is driven by an oscillation motor in the head unit 18. As seen in FIGS. 1 and 2, the lower end of the oscillation shaft 16 extends past the lower end of the support tube 14 and is attached to the circulation assembly 20.

Figure 4:
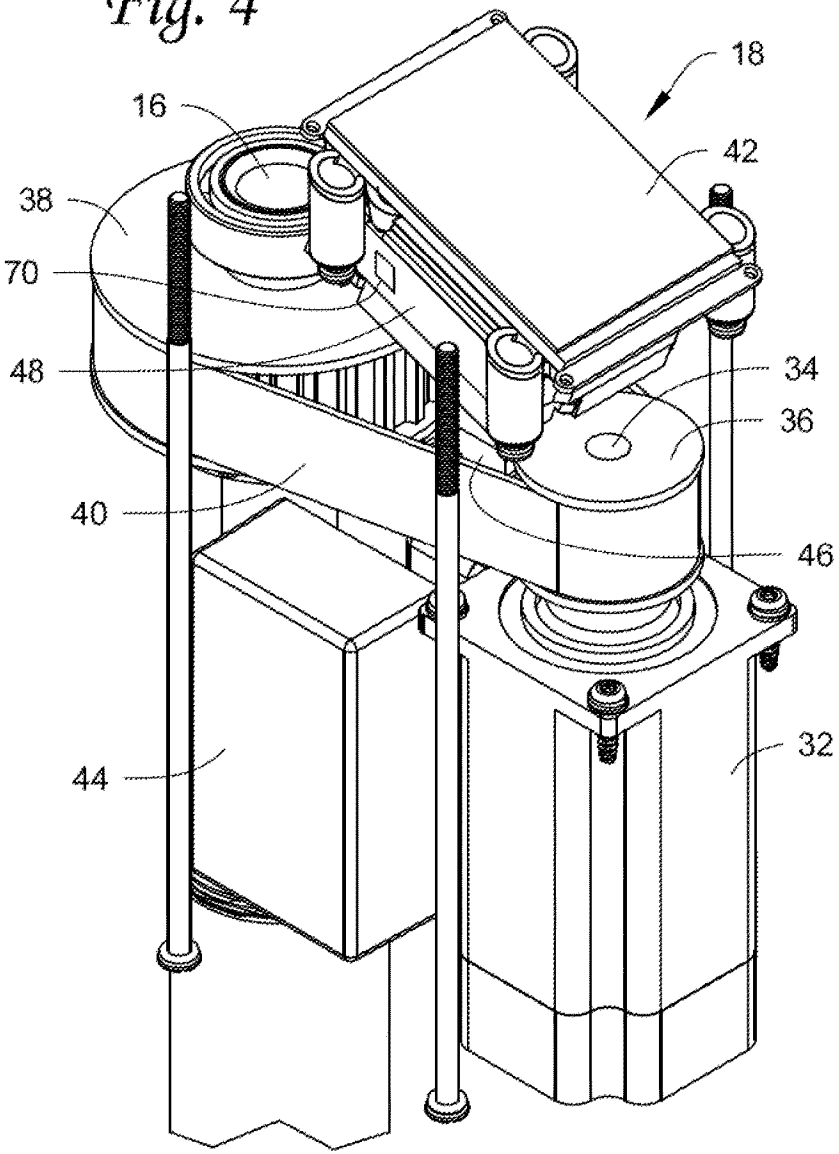
FIG. 4 depicts the head unit with the housing removed to depict interior components of the head unit.
Figure 3:
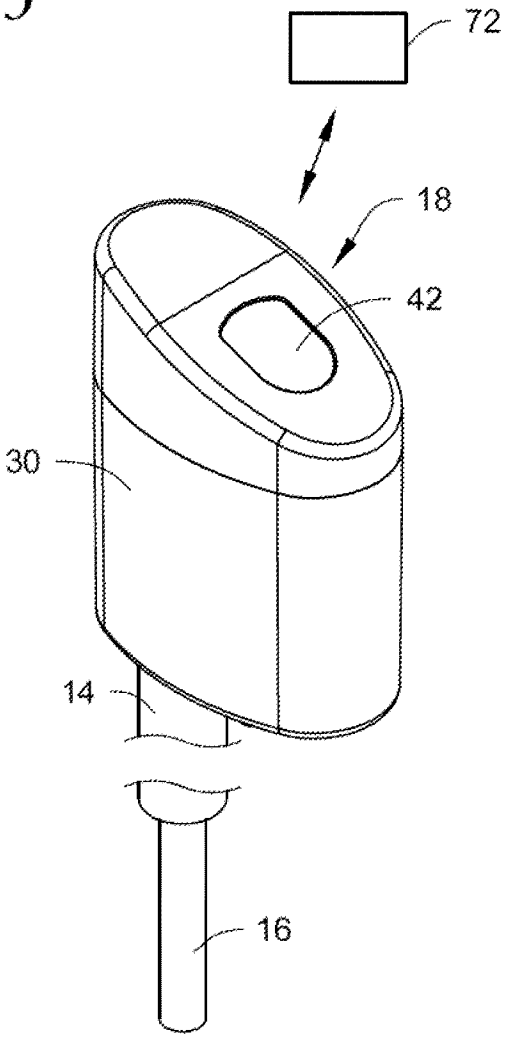
FIG. 3 is a close-up view of the head unit mounted at the top of the circulator.

Referring to FIGS. 3-4, the head unit 18 is mounted to the upper end of the support tube 14. The head unit 18 is configured to control operation of the circulator 10 including causing oscillation of the circulation assembly 20 via the oscillation shaft 16. The head unit 18 includes a housing 30 and an electric oscillation motor 32 disposed in the housing 30. The electric oscillation motor 32 has an output drive shaft 34 that is in driving engagement with the oscillation shaft 16 via any suitable drive train to drive the oscillation shaft 16 in clockwise and counterclockwise directions. The electric oscillation motor 32 can be any type of reversible electric motor that is suitable for driving the oscillation shaft 16. For example, the motor 32 can be a stepper motor which provides more precise speed control and positional control of the oscillation.

Figure 7:
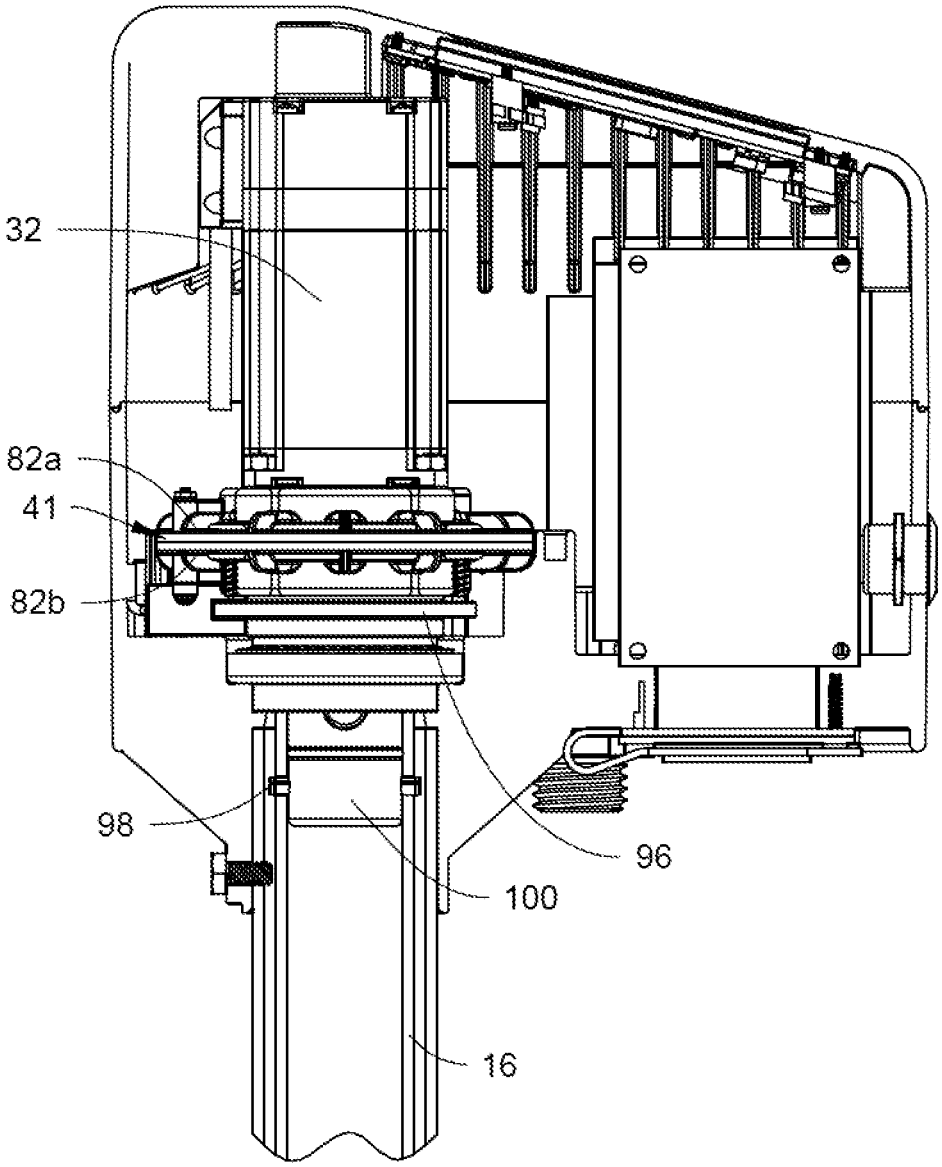
FIG. 7 illustrates another embodiment of a circulator that uses a cycloidal drive mechanism.

A drive train is provided between the output drive shaft 34 and the oscillation shaft 16. The drive train can have any configuration to impart oscillating rotation of the drive shaft 34 to the oscillation shaft 16. In the example illustrated in FIG. 4, the drive train includes a first drive pulley 36 connected to and driven by the output drive shaft 34, a second drive pulley 38 connected to and driving the oscillation shaft 16, and a drive belt 40 engaged with the first drive pulley 36 and the second drive pulley 38. The drive pulleys 36, 38 can have teeth that are engaged with teeth on the inner surface of the belt 40 to ensure non-slip driving between the belt 40 and the pulleys 36, 38. The rotation of the output shaft 34 drives the pulley 36 which in turn drives the pulley 38 via the belt 40 to cause rotation of the oscillation shaft 16 in the desired direction depending upon the rotation direction of the output shaft 34. However, other drive trains can be used including, but not limited to, gears and a chain. For example, FIG. 7 illustrates the drive train as being a cycloidal drive 41 between the drive shaft of the motor 32 and the oscillation shaft 16. The general construction and operation of cycloidal drive mechanisms is well-known in the art.

Figure 8:
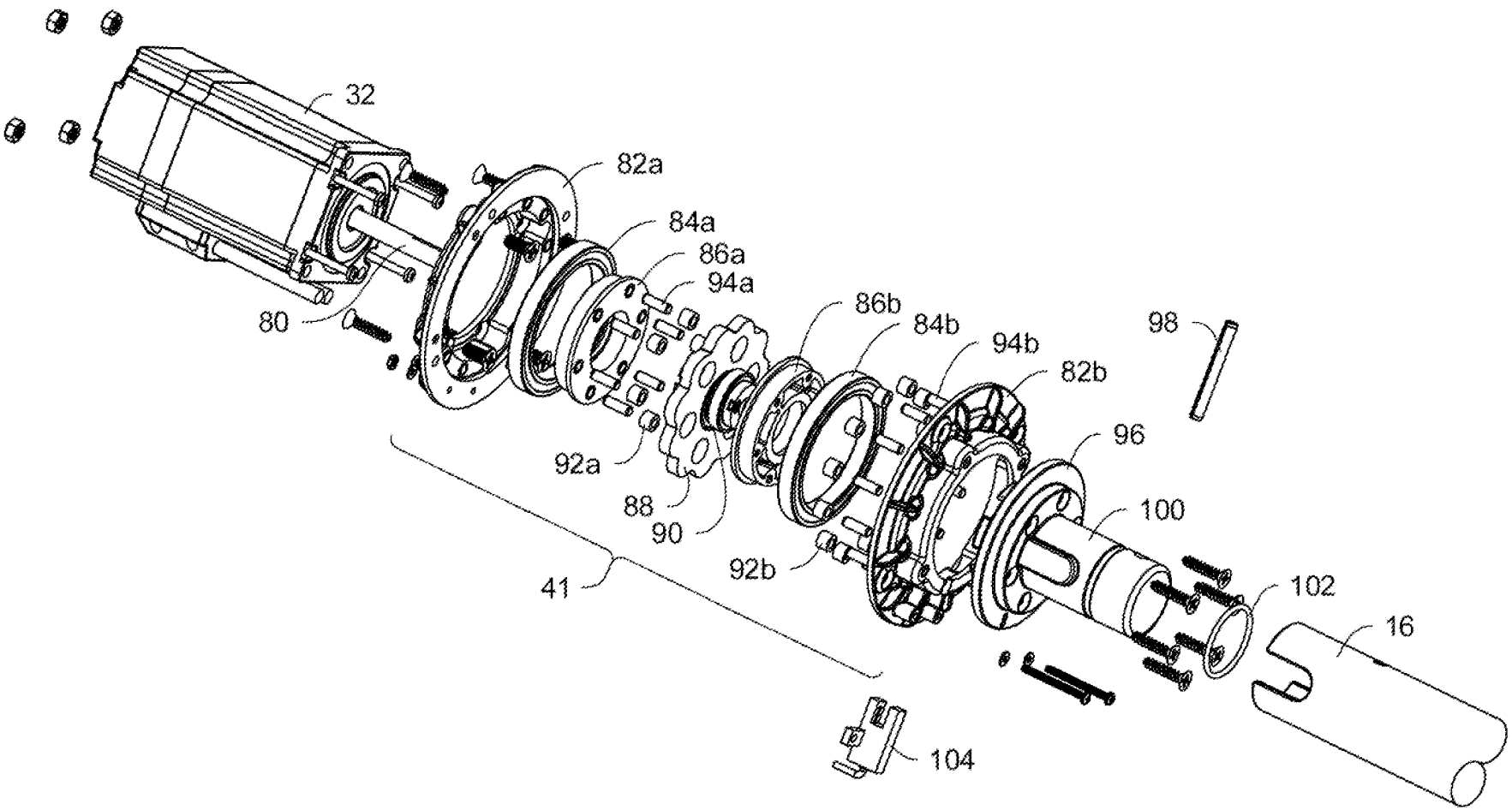
FIG. 8 is an exploded view of the cycloidal drive mechanism.

FIGS. 7 and 8 illustrate in detail the connection between the motor 32, the cycloidal drive 41 and the oscillation shaft 16. In particular, the connection is in-line where the drive shaft 80 of the motor 32 is in-line with and coaxial to the oscillation shaft 16. The cycloidal drive 41 includes upper and lower outer lids/post supports 82*a*, 82*b*, upper and lower bearings 84*a*, 84*b*, upper and lower inner caps/post supports 86*a*, 86*b*, cycloidal wheel 88, cam and bearing assembly 90, upper and lower sets of roller bushings 92*a*, 92*b*, and upper and lower post/roller bushings 94*a*, 94*b*. In addition, the connection includes an optical rotation/end-stop sensor disk 96, an oscillation shaft set pin 98, an oscillation shaft torque transfer tube 100, an oscillation shaft gasket 102, and a photo-interrupter sensor 104.

As seen in FIGS. 3-4, the head unit 18 further includes a touch-sensitive control screen 42 (i.e. a touchscreen) through which control inputs can be entered for controlling operation of the circulator 10. Examples of control inputs that can be input via the control screen 42 include, but are not limited to, on/off control of the circulator 10, on/off control of the motor of the circulation assembly 20, speed control of the motor of the circulation assembly 20, on/off control of the oscillation motor 32, speed control of the oscillation motor 32, and permit adjustment of the angular oscillation extent of the oscillation motor 32 thereby controlling the oscillation range (i.e. the amount of sweep) of the circulation assembly 20 when driven by the oscillation shaft 16. The head unit 18 further includes an AC-DC converter 44, an AC power relay 46, and control electronics 48. Electrical power for the circulator 10 can be provided via a power cord plugging into a conventional electrical outlet. Conventional circulators typically utilize two power cords, the first extending from an electrical outlet to the controller and the second extending from an electrical outlet to the circulation assembly. In another embodiment, the circulator 10 can be powered by one or more batteries and/or by one or more solar panels.

Operation of the circulator 10 may also be wirelessly controlled. For example, referring to FIGS. 3 and 4, the head unit 18 may include a wireless transceiver 70 that can receive wireless control signals from a control device 72, such as a mobile phone, tablet or other suitable device, for controlling the circulator 10. In an embodiment, the transceiver 70 may also wirelessly transmit one or more signals, such as operational data or operational status of the circulator 10, to the control device. Any type of wireless communication technology can be used including, but not limited to, WiFi, Bluetooth®, ZigBee, and others.

Referring to FIG. 2, the head unit 18 may include one or more lights. For example, the head unit 18 can include one or more lights 74 thereon that can be located at any position on the head unit 18 such that the light emitted therefrom is visible from the exterior of the head unit 18. The light 74 may continuously illuminate or the light 74 may be controlled to strobe (i.e. repeatedly flash on and off). When illuminated, the light 74 may act as a homing beacon to allow a user to locate the dock at night. In addition or alternatively, the head unit 18 can include one or more lights 76 thereon. The light 76 can be positioned at any position on the head unit 18 such that light emitted therefrom shines generally downward to illuminate the adjacent surface of the support structure 24, such as a dock thereby making walking on the dock safer at night, reduce tripping hazard, and the like. In one embodiment, a single light that performs the functions of the lights 74, 76 can be used.

The lights 74, 76 may include one or more light emitting diodes or other light emitting elements. The lights 74, 76 may emit white light or colored light such as red or blue, or the lights 74, 76 may alternate between white and colored light. Operation of the lights 74, 76 may be controlled via the control screen 42, remotely via the control device 72, the lights 74, 76 may be operated by a timer, or the head unit 18 can include a photosensor that detects ambient light levels and that activates the lights 74, 76 when it becomes dark outside.

Returning to FIGS. 1-2, the circulation assembly 20 is mounted to the oscillation shaft 16 at a lower end thereof so that the circulation assembly 20 oscillates with the oscillation shaft 16. The circulation assembly 20 is configured to generate the liquid circulation and includes a rotatable propeller 50 and a drive motor 52 connected to the rotatable propeller 50 to rotate the rotatable propeller 50. The propeller 50 can have any configuration that generates a flow of liquid when rotated. The flow of liquid generated by the propeller 50 can be an axial flow of liquid that flows in a direction away from the drive motor 52. The drive motor 52 can be a one-way, electrically driven motor. Electrical power for powering the drive motor 52 can be provided by an electrical power cord 54 that can be routed from the head unit 18 and through either the oscillation shaft 16 or through the support tube 14. In one embodiment, a propeller guard 56 can be provided around the propeller 50 to protect against contact with the propeller 50 and to prevent large debris from reaching the propeller 50.

Figure 5:
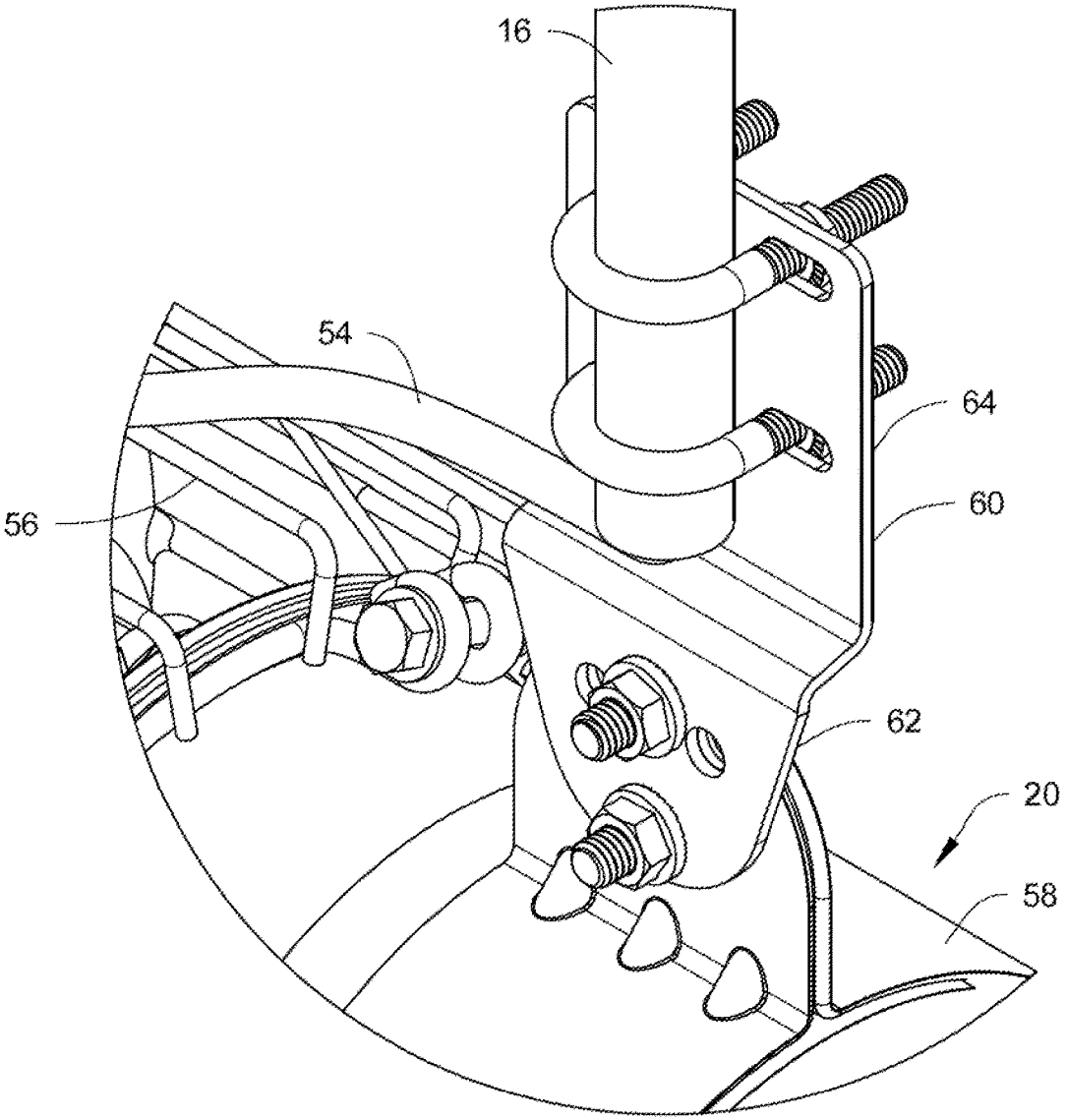
FIG. 5 is a close-up view of the connection between the circulation assembly and the oscillation shaft.
Figure 6:
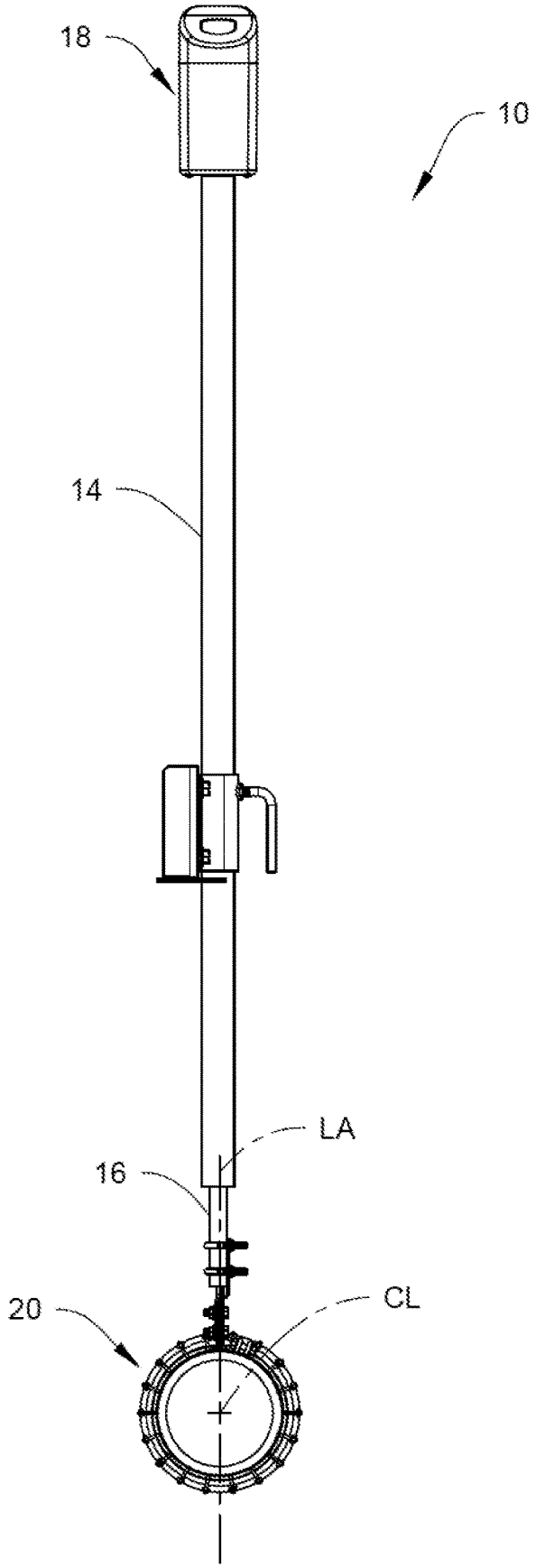
FIG. 6 is an end view of the circulator.

Referring to FIGS. 2 and 5-6, the circulation assembly 20 can be fixed to the oscillation shaft 16 in such a manner so that, in an end view of the circulator 10 (see FIG. 6), the axial centerline CL of the circulation assembly 20 is intersected by the longitudinal axis LA of the oscillation shaft 16. This avoids an off-axis load from the thrust of the circulation assembly 20 and reduces stress on the support tube 14, the oscillation shaft 16, and attachment points. Any type of mounting that achieves intersection between the longitudinal axis LA of the oscillation shaft 16 and the axial centerline CL of the circulation assembly 20 can be used. In the illustrated example, the mounting comprises a circular clamp 58 surrounding the drive motor 52, and a bracket 60 that attaches the clamp 58 to the oscillation shaft 16. The clamp 58 is located at approximately the midpoint of the drive motor 52. The bracket 60 includes a lower portion 62 and an upper portion 64 that is offset from the lower portion 62. The bottom portion of the oscillation shaft 16 is clamped to the offset upper portion 64. The offset of the upper portion 64 is sufficient to ensure that the longitudinal axis LA of the oscillation shaft 16 intersects the axial centerline CL of the circulation assembly 20. However, other mechanisms for attaching the circulation assembly 20 to the oscillation shaft 16 can be used.

In one embodiment, the circulation assembly 20 can be mounted to the oscillation shaft 16 in a manner to permit vertical angle adjustment of the circulation assembly 20. The adjustment of the vertical angle may be manual by adjusting the mounting between the oscillation shaft 16 and the circulation assembly 20 via different adjustment positions on the bracket 60. In another embodiment, the adjustment of the vertical angle may be automated, for example using a linkage between the head unit 18 and the circulation assembly 20 which is driven by a motor on the head unit 18. In another embodiment, the circulation assembly 20 can be continuously oscillated side-to-side as well as continuously driven to oscillate by changing its vertical angle up and down as it oscillates side-to-side. This complex side-to-side oscillation and up-down oscillation would affect the liquid flow over a larger range compared to a fixed vertical angle of the circulation assembly 20.

Another embodiment of a circulator 150 is depicted in FIGS. 9-13. The circulator 150 is configured to create a continuous circulation within a body of liquid (shown in FIG. 2) such as a lake, pond, river, canal and the like, for example to circulate water in a localized area in a body of water. The localized area may be at or near a marina, around or adjacent to a dock, near a waterfront or other location, and other locations in a body of water. However, the circulator 150 can be used to create circulation in other bodies of liquid other than water or mixtures of water and other liquid(s)

including, but not limited to, treatment tanks for water and/or chemicals for mixing the contents to keep solids and chemicals in suspension and evenly distributed. Any of the features described above for the circulator 10 can be used individually or in any combination thereof in the circulator 150. In addition, any of the features described below for the circulator 150 can be used individually or in any combination thereof in the circulator 10.

Figure 9:
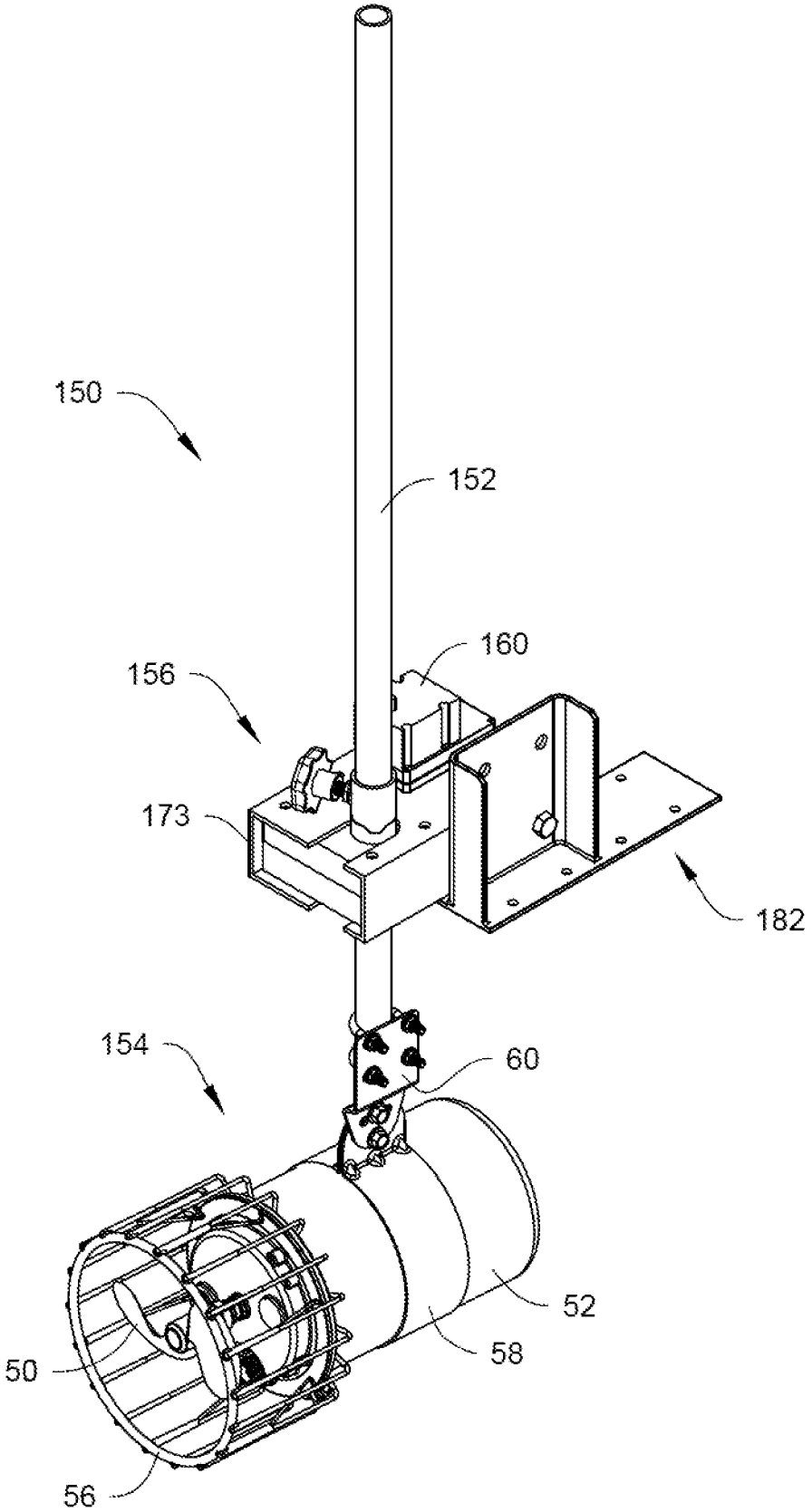
FIG. 9 depicts another embodiment of a circulator described herein.

Referring initially to FIG. 9, the circulator 150 is depicted as including an oscillation shaft 152, a circulation assembly 154, and a head unit 156. In operation, the circulation assembly 154 is disposed within a body of liquid to create the circulation, and the head unit 156 is located above and out of the liquid.

The oscillation shaft 152 is attached to the circulation assembly 154 and is rotatable in clockwise and counterclockwise directions in order to oscillate the circulation assembly 154 in the body of liquid. The oscillator shaft 152 causes oscillation of the circulation assembly 154 about the axis of the oscillation shaft 152 along a horizontal plane in clockwise and counterclockwise directions. The oscillation shaft 152 may be solid or tubular, and the oscillation shaft 152 may be circular in cross-section or have another cross-sectional shape such as square, rectangular or triangular. The oscillation shaft 152 can be formed of material that is suitable for use in a liquid environment such as metal or plastic. As described in more detail below, the oscillation shaft 152 extends into and through the head unit 156 so that an upper end of the oscillation shaft 152 is disposed above the head unit 156, and the oscillation shaft 152 is driven by a motor in the head unit 156. As seen in FIG. 9, the lower end of the oscillation shaft 152 and is attached to the circulation assembly 154.

The circulation assembly 154 is mounted to the oscillation shaft 152 at a lower end thereof so that the circulation assembly 154 oscillates with the oscillation shaft 152. The circulation assembly 154 can have any construction that is suitable for creating a flow of liquid. In one embodiment, the circulation assembly 154 can have a construction that is the same as the circulation assembly 20, and elements in the circulation assembly 154 that are the same as elements in the circulation assembly 20 are referenced using the same reference numerals. The circulation assembly 154 includes the rotatable propeller 50, and the drive motor 52, such as a one-way electrically driven motor, connected to the rotatable propeller 50 to rotate the rotatable propeller 50 to create the flow of liquid generated by the propeller 50. Electrical power for powering the drive motor 52 can be provided by an electrical power cord (not shown in FIG. 9) that can be routed from the head unit 156. The propeller guard 56 can be provided around the propeller 50 to protect against contact with the propeller 50 and to prevent large debris from reaching the propeller 50.

Like with the circulation assembly 20, the circulation assembly 154 can be fixed to the oscillation shaft 152 in such a manner so that, in an end view of the circulator 150, the axial centerline of the circulation assembly 154 is intersected by the longitudinal axis of the oscillation shaft 152. This avoids an off-axis load from the thrust of the circulation assembly 154 and reduces stress on the oscillation shaft 152 and attachment points. Any type of mounting that achieves intersection between the longitudinal axis of the oscillation shaft 152 and the axial centerline of the circulation assembly 154 can be used. In the illustrated example, the mounting comprises the circular clamp 58 surrounding the drive motor 52, and the bracket 60 that attaches the clamp 58 to the oscillation shaft 152. The clamp 58 is located at approximately the midpoint of the drive motor 52. The bracket 60 includes the lower portion and the upper portion as described above, with the bottom portion of the oscillation shaft 152 clamped to the upper portion. The offset of the upper portion is sufficient to ensure that the longitudinal axis of the oscillation shaft 152 intersects the axial centerline of the circulation assembly 154. However, other mechanisms for attaching the circulation assembly 154 to the oscillation shaft 152 can be used.

In one embodiment, the circulation assembly 154 can be mounted to the oscillation shaft 152 in a manner to permit vertical angle adjustment of the circulation assembly 154. The adjustment of the vertical angle may be manual by adjusting the mounting between the oscillation shaft 152 and the circulation assembly 154 via different adjustment positions on the bracket 60. In another embodiment, the adjustment of the vertical angle may be automated, for example using a linkage between the head unit 156 and the circulation assembly 154 which is driven by a motor on the head unit 156. In another embodiment, the circulation assembly 154 can be continuously oscillated side-to-side as well as continuously driven to oscillate by changing its vertical angle up and down as it oscillates side-to-side. This complex side-to-side oscillation and up-down oscillation would affect the liquid flow over a larger range compared to a fixed vertical angle of the circulation assembly 154.

Figure 12:
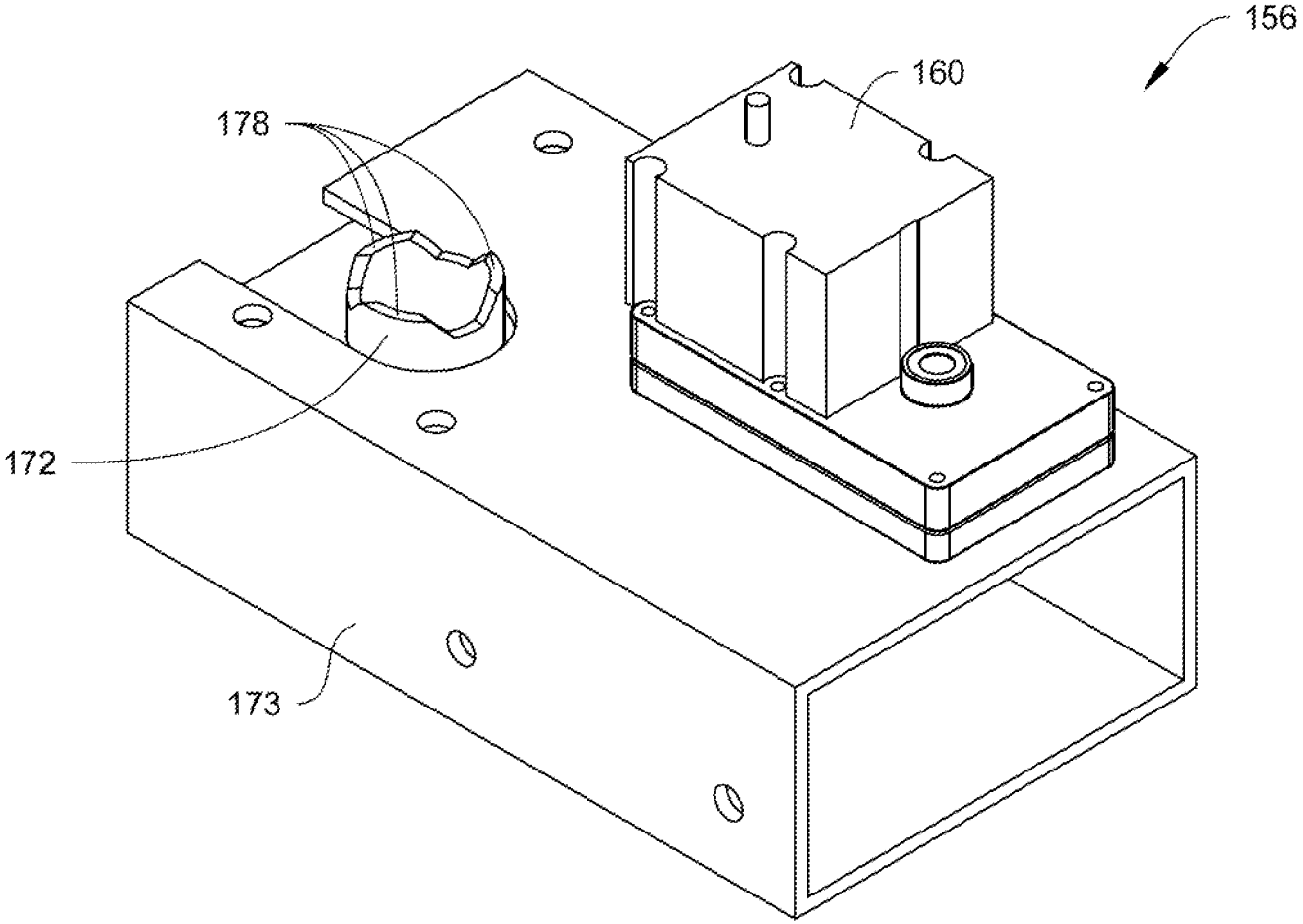
FIG. 12 is a top perspective view of the head unit.
Figure 13:
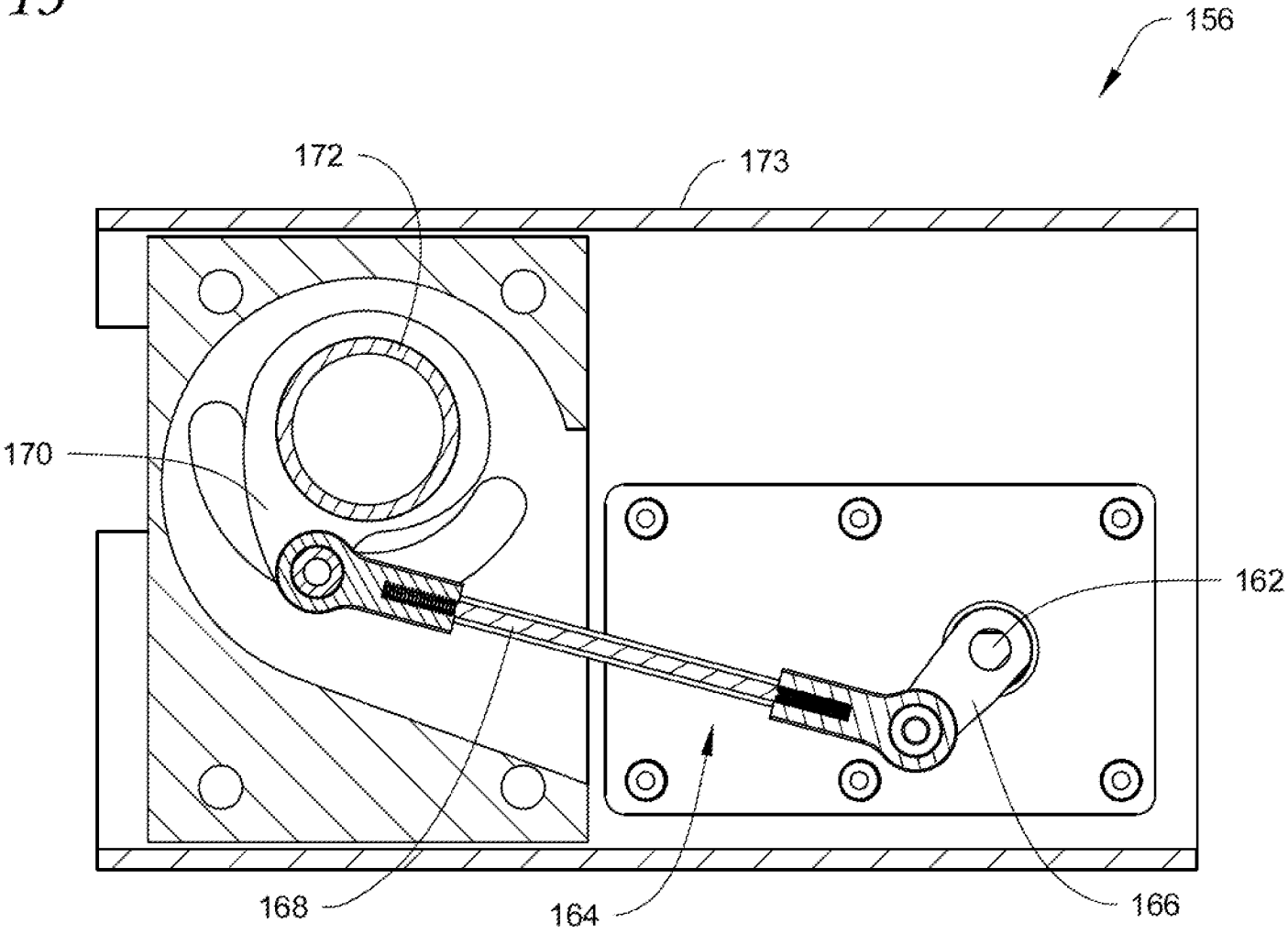
FIG. 13 is an internal view of the head unit showing a rotary to oscillation drive mechanism connected to the drive shaft of the head unit motor.

Referring to FIGS. 9, 12 and 13, the head unit 156 is located above the circulation assembly 154. The head unit 156 includes a motor 160 with a rotary output shaft 162 (FIG. 13) in driving engagement with the oscillation shaft 152. The motor 160 can be a one-way electrically driven motor that rotates the output shaft 162 in a single direction. In an embodiment, the motor 160 can be an alternating current (AC) motor. However, the motor 160 can alternatively be a direct current (DC) motor.

A drive mechanism 164 connects the output shaft 162 to the oscillation shaft 152 so that the output shaft 162 drives the oscillation shaft 152. The drive mechanism 164 comprises a rotary to oscillation drive mechanism between the output shaft 162 and the oscillation shaft 152 that is configured to convert rotation of the output shaft 162 into clockwise and counterclockwise oscillation of the oscillation shaft 152. The drive mechanism 164 can have any configuration that is suitable to convert rotation of the shaft 162 into oscillation of the oscillation shaft 152. In the example illustrated in FIGS. 12 and 13, the drive mechanism 164 comprises a crank 166 connected at one end thereof to the output shaft 162 and connected at its opposite end to a connecting link 168. The opposite end of the connecting link 168 is fixed to a crank 170 that is fixed to a drive sleeve 172. In operation of the drive mechanism 164, rotation of the output shaft 162 rotates the crank 166 about the axis of the shaft 162. The rotation of the crank 166 drives the connecting link 168 axially which in turn causes oscillation of the crank 170 and the drive sleeve 172. Referring to FIGS. 9-13, portions of the drive mechanism 164, such as the crank 166, the connecting link 168, and the crank 170, can be disposed within a housing 173 of the head unit 156

Figure 10:
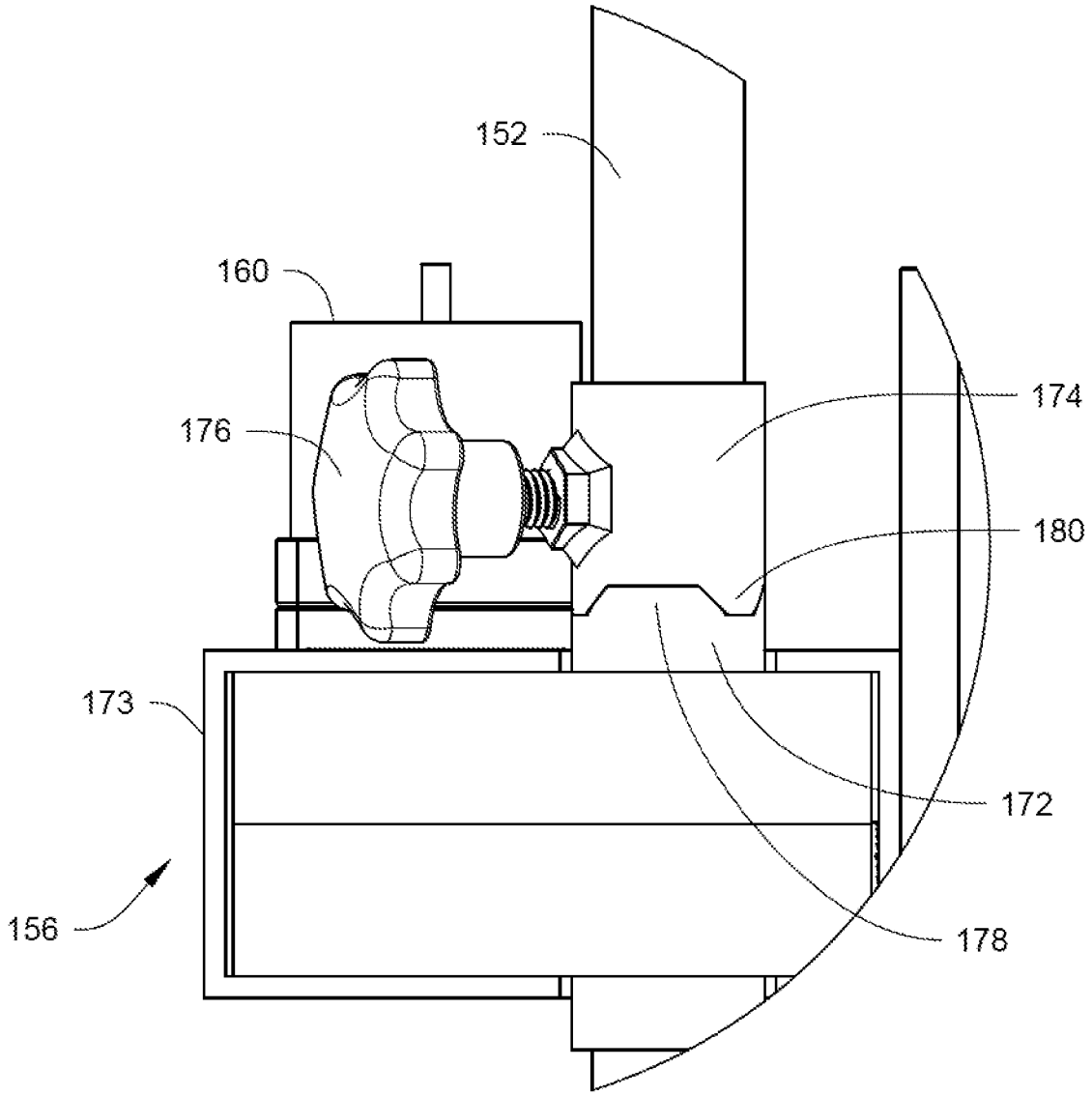
FIG. 10 is a close-up view of an automatic clutch mechanism of the drive mechanism, with the automatic clutch mechanism in an engaged position.
Figure 11:
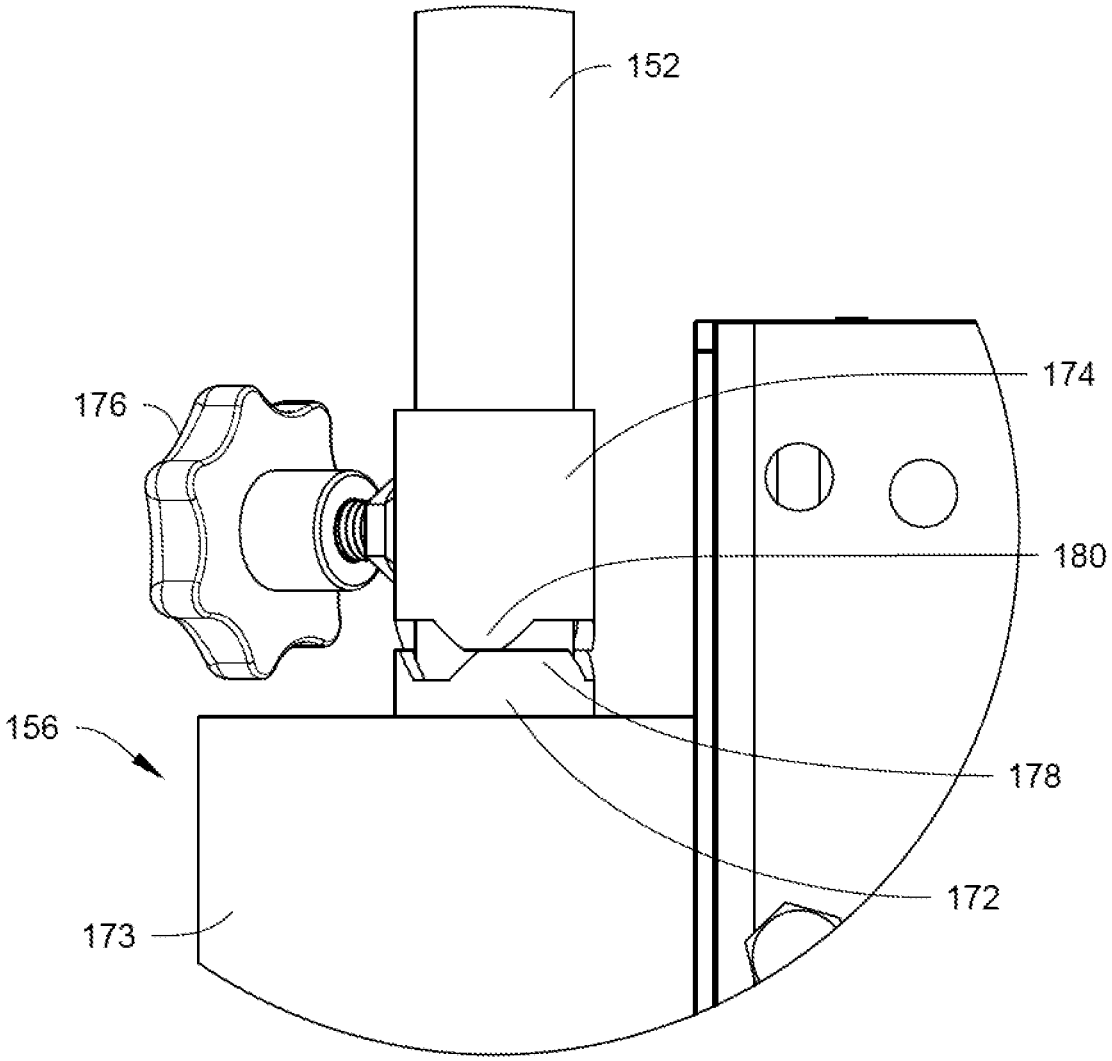
FIG. 11 is close-up view similar to FIG. 10 with the automatic clutch mechanism is a disengaged position.

Referring to FIGS. 10-12, the drive sleeve 172 is in driving engagement with the oscillation shaft 152 whereby oscillation of the drive sleeve 172 causes oscillation of the oscillation shaft 152. Any mechanism for connecting the drive sleeve 172 to the oscillation shaft 152 can be used. For example, referring to FIGS. 10-11, the oscillation shaft 152 is depicted as including a sleeve 174 fixed thereto. The sleeve 174 can be fixed to the oscillation shaft 152 in any manner to prevent relative movement between the sleeve 174 and the oscillation shaft 152 when the sleeve 174 is driven by the drive sleeve 172. As depicted in FIGS. 10-11, the sleeve 174 is fixed to the oscillation shaft 152 by a set screw 176. However, the sleeve 174 can be welded to the shaft 152, formed integrally with the shaft 152, or fixed to the shaft 152 using any other fixation means.

With continued reference to FIGS. 10-12, the upper end of the drive sleeve 172 includes circumferentially spaced teeth or castellations 178 that engage with circumferentially spaced teeth or castellations 180 on the bottom end of the sleeve 174. The teeth 178, 180 form an automatic clutch mechanism between the output shaft 162 and the oscillation shaft 152, for example, in the drive mechanism 164. If the circulation assembly 154 encounters an obstacle while being oscillated by the oscillation shaft 152, the teeth 178, 180 will ride up on one another while slightly lifting the oscillation shaft 152 vertically so that the teeth 178, 180 disengage as depicted in FIG. 11. This stops oscillation of the circulation assembly 154 while allowing the output shaft 162 to continue to rotate.

Unlike conventional circulators, the circulator 150 is configured to be simple in operation. For example, the circulator 150 is devoid of a processor, microprocessor, microcontroller, etc. controlling operation of the circulator 150.

A mount bracket 182 (or a dock mount when used as a water circulator in a body of water) is connected to the head unit 156, for example to the housing 173, for mounting the circulator 150 to a support structure such as a dock or pier when used as a water circulator. A suitable mount bracket that can be used is available from Kasco Marine of Prescott, Wisconsin. The mount bracket 182 can have a construction that is similar to the mount bracket 22 in FIGS. 1-2.

Additional examples of the circulator can include, but are not limited to, the following.

Example 1. A circulator can include a support tube; an oscillation shaft disposed within the support tube, the oscillation shaft is rotatable relative to the support tube in clockwise and counterclockwise directions; a head unit mounted to the support tube, the head unit includes a housing, and an oscillation motor disposed in the housing and having an output drive shaft in driving engagement with the oscillation shaft to drive the oscillation shaft in clockwise and counterclockwise directions; and a circulation assembly mounted to the oscillation shaft at a lower end thereof, the circulation assembly includes a rotatable propeller, and a drive motor connected to the rotatable propeller to rotate the rotatable propeller.

Example 2. The circulator of example 1, wherein the oscillation shaft is concentrically disposed within the support tube.

Example 3. The circulator of examples 1 or 2, further comprising a dock mount connected to the support tube.

Example 4. The circulator of any one of examples 1 to 3, wherein the head unit includes a touch-sensitive control screen that controls operation of the oscillation motor.

Example 5. The circulator of any one of examples 1 to 4, wherein the oscillation motor comprises a stepper motor, and further comprising a drive train between the output drive shaft and the oscillation shaft.

Example 6. The circulator of example 5, wherein the drive train comprises a cycloidal drive.

Example 7. The circulator of any one of examples 1 to 6, wherein the output drive shaft is in-line with and coaxial to the oscillation shaft.

Example 8. The circulator of any one of examples 1 to 7, further comprising a homing beacon light mounted on the head unit.

Example 9. The circulator of any one of examples 1 to 8, further comprising a light mounted on the head unit, the light positioned to emit light in a downward direction toward a support structure.

Example 10. The circulator of any one of examples 1 to 9, wherein the head unit includes a wireless communication device.

Example 11. A liquid circulator for creating liquid circulation in a body of liquid can include: a support tube configured to be mounted to a support structure; an oscillation shaft concentrically disposed within the support tube, the oscillation shaft is rotatable relative to the support tube in clockwise and counterclockwise directions; a head unit mounted to the support tube and configured to reside above the liquid, the head unit includes a housing, and an electric oscillation motor disposed in the housing and having an output drive shaft in driving engagement with the oscillation shaft to drive the oscillation shaft in clockwise and counterclockwise directions; and a liquid circulation assembly mounted to the oscillation shaft at a lower end thereof so as to be oscillated by the oscillation shaft and configured to reside in the liquid to create the liquid circulation, the liquid circulation assembly includes a rotatable liquid propeller, and an electric drive motor connected to the rotatable liquid propeller to rotate the rotatable liquid propeller.

Example 12. The liquid circulator of example 11, further comprising a mount bracket connected to the support tube to mount the support tube to the support structure.

Example 13. The liquid circulator of example 11 or 12, wherein the head unit includes a touch-sensitive control screen that controls operation of the electric oscillation motor.

Example 14. The liquid circulator of any one of examples 11 to 13, wherein the electric oscillation motor comprises a stepper motor, and further comprising a drive train between the output drive shaft and the oscillation shaft.

Example 15. The liquid circulator of example 14, wherein the drive train comprises a cycloidal drive.

Example 16. The liquid circulator of any one of examples 11 to 15, wherein the output drive shaft is in-line with and coaxial to the oscillation shaft.

Example 17. The liquid circulator of any one of examples 11 to 16, further comprising a homing beacon light mounted on the head unit.

Example 18. The liquid circulator of any one of examples 11 to 17, further comprising a light mounted on the head unit, the light positioned to emit light in a downward direction toward a support structure.

Example 19. The liquid circulator of any one of examples 11 to 18, wherein the head unit includes a wireless communication device.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A liquid circulator, comprising:

an oscillation shaft that is rotatable in clockwise and counterclockwise directions;

a circulation assembly mounted to the oscillation shaft at a lower end thereof, the circulation assembly including a rotatable propeller that circulates a liquid, and a drive motor connected to the rotatable propeller to rotate the rotatable propeller;

a head unit located above the circulation assembly, the head unit including a motor with a rotary output shaft;

the oscillation shaft extending into and through the head unit whereby an upper end of the oscillation shaft is disposed above the head unit; and a drive mechanism associated with the head unit between the rotary output shaft and the oscillation shaft that is configured to convert rotation of the rotary output shaft into clockwise and counterclockwise oscillation of the oscillation shaft, wherein the drive mechanism is indirectly connected to the oscillation shaft whereby the oscillation shaft is indirectly driven by the drive mechanism and the oscillation shaft is configured to be raised and lowered relative to the head unit and the motor of the head unit.

2. The liquid circulator of claim 1, further comprising a mount bracket attached to the head unit, wherein the mount bracket is configured to mount the liquid circulator to a support structure.

3. The liquid circulator of claim 2, wherein the mount bracket comprises a dock mount, and the support structure comprises a dock.

4. The liquid circulator of claim 1, wherein the motor of the head unit is an alternating current motor.

5. The liquid circulator of claim 1, wherein the liquid circulator is devoid of a processor controlling operation of the liquid circulator.

6. The liquid circulator of claim 1, wherein the drive mechanism includes a drive sleeve surrounding the oscillation shaft; and further comprising a sleeve that is separate from and located above the drive sleeve and that surrounds the oscillation shaft and wherein the sleeve is fixed to the oscillation shaft by a fixation means; wherein the drive sleeve includes an upper end, the sleeve includes a lower end, and the upper end of the drive sleeve is engaged with the lower end of the sleeve.

7. The liquid circulator of claim 6, wherein the fixation means comprises a set-screw.

* * * * *